US011594831B2

(12) United States Patent
Brodbeck et al.

(10) Patent No.: US 11,594,831 B2
(45) Date of Patent: Feb. 28, 2023

(54) DIRECT PLUG-IN CONNECTOR

(71) Applicant: Würth Elektronik eiSos GmbH & Co. KG, Waldenburg (DE)

(72) Inventors: Micha Brodbeck, Ammertsweiler (DE); Stefan Schilpp, Weißlensburg (DE)

(73) Assignee: WÜRTH ELEKTRONIC EISOS GMBH & CO. KG, Waldenburg (DE)

( * ) Notice: Subject to any disclaimer, the term of this patent is extended or adjusted under 35 U.S.C. 154(b) by 0 days.

(21) Appl. No.: 17/261,408

(22) PCT Filed: Jul. 2, 2020

(86) PCT No.: PCT/EP2020/068692
§ 371 (c)(1),
(2) Date: Jan. 19, 2021

(87) PCT Pub. No.: WO2021/004893
PCT Pub. Date: Jan. 14, 2021

(65) Prior Publication Data

US 2022/0140511 A1 May 5, 2022

(30) Foreign Application Priority Data

Jul. 10, 2019 (DE) ..... 102019210235.2

(51) Int. Cl.
*H01R 12/70* (2011.01)
*H01R 12/75* (2011.01)
*H01R 13/432* (2006.01)

(52) U.S. Cl.
CPC ..... *H01R 12/7023* (2013.01); *H01R 12/75* (2013.01); *H01R 13/432* (2013.01)

(58) Field of Classification Search
CPC ..... H01R 23/7057; H01R 12/7052; H01R 13/502; H01R 12/7023; H01R 12/75; H01R 13/432
(Continued)

(56) References Cited

U.S. PATENT DOCUMENTS 5,108,308 A * 4/1992 Northcraft ..... H01R 12/7052 439/571
5,322,452 A * 6/1994 Mosquera ..... H01R 12/7064 439/571
(Continued)

FOREIGN PATENT DOCUMENTS

CN 101944661 A 1/2011
CN 108352636 A 7/2018
(Continued)

OTHER PUBLICATIONS

EU Trademark Information for SKEDD; TM Filing No. 010723948; filed on Mar. 14, 2012; Owner: Wurth Elektronik ICS GMBH & CO KG.
(Continued)

*Primary Examiner* — Gary F Paumen
(74) *Attorney, Agent, or Firm* — Boyle Fredrickson S.C.

(57) ABSTRACT

The invention relates to a direct plug-in connector (1) for establishing an electric connection between a conductor (30) and a metallized through opening (40) of a printed circuit board (50). The direct plug-in connector (1) has a fastening element (4) and a contact (2) with at least one first contact arm (3*a*). The first contact arm (3*a*) is configured for the electric connection of the conductor (30) to the metallized through opening (40). The fastening element (4) can assume a fastening position and a release position, the fastening element (4) being configured to fasten the direct plug-in connector (1) to the metallized through opening (40) in the fastening position.

14 Claims, 9 Drawing Sheets

(58) Field of Classification Search
USPC ..... 439/571, 572
See application file for complete search history.

(56) References Cited

U.S. PATENT DOCUMENTS

| | | | | |
|---|---|---|---|---|
| 5,800,209 | A | 9/1998 | Suzuki | |
| 6,024,603 | A * | 2/2000 | Chen | H01R 12/7047 439/571 |
| 6,171,133 | B1 * | 1/2001 | Altuner | H01R 12/7005 439/79 |
| 6,244,875 | B1 * | 6/2001 | McHugh | H01R 12/7047 439/571 |
| 6,454,600 | B1 * | 9/2002 | Jones | H01R 12/7058 439/571 |
| 8,075,322 | B2 | 12/2011 | Schwettmann et al. | |
| 10,665,970 | B2 | 5/2020 | Geske | |

FOREIGN PATENT DOCUMENTS

| | | | |
|---|---|---|---|
| DE | 102013214232 | A1 | 1/2015 |
| DE | 102014108001 | A1 | 12/2015 |
| DE | 102016111926 | A1 | 1/2018 |
| DE | 202016105358 | U1 | 1/2018 |
| DE | 202015009518 | U1 | 2/2018 |
| DE | 202018100416 | U1 | 2/2018 |
| EP | 0955796 | A2 | 4/1999 |
| EP | 3392971 | A | 10/2018 |
| JP | H06260251 | A | 9/1994 |
| JP | H11297432 | A | 10/1999 |
| JP | 2016-152214 | A | 8/2016 |

OTHER PUBLICATIONS

German Office Action, dated Nov. 7, 2022, 8 pages.
English Machine Transcription of DE 102014108001 A1, 19 pages.

* cited by examiner

DIRECT PLUG-IN CONNECTOR

FIELD OF THE INVENTION

The invention relates to a direct plug-in connector for establishing an electric connection between a conductor and a metallized through opening of a printed circuit board, with a contact with at least one first contact arm, the first contact arm being configured for the electric connection of the conductor to the metallized through opening, and with a fastening element which can assume a fastening position and a release position.

BACKGROUND

DE 10 2013 214 232 A1 discloses a plug-in apparatus with two plug-in elements which lie opposite one another and a clamping pin which can be moved relative to the plug-in elements.

DE 10 2016 111 926 A1 discloses a plug-in contact with a bracket arm.

DE 10 2015 119 484 A1 discloses a plug-in contact which is bent away in an L-shaped manner.

SKEDD contacts (SKEDD is a trademark, EU010723948) are known which make a vibration-proof connection and reversible plugging into a metallized drilled hole of a printed circuit board possible. A SKEDD contact is produced by way of punching and subsequent bending, the SKEDD contact being produced from a piece of material and having two different material thicknesses.

SUMMARY

The invention is based on the object of the provision of a direct plug-in connector which has a compact overall design, is inexpensive to produce, and increases the stability of a mechanical and electric connection.

The invention achieves the object by the provision of a direct plug-in connector with the features of Claim 1. Advantageous refinements of the invention are described in the subclaims.

The direct plug-in connector according to the invention for establishing an electric connection between a conductor and a metallized through opening of a printed circuit board has a fastening element and a contact with at least one first contact arm. The first contact arm is configured for the electric connection of the conductor to the metallized through opening. The fastening element can assume a fastening position and a release position, the fastening element being configured for fastening of the direct plug-in connector to the metallized through opening in the fastening position.

A compact overall design of the direct plug-in connector is achieved by way of the use of the metallized through opening both for the fastening of the direct plug-in connector and for establishing the electric connection. The compact overall design allows the material costs of the direct plug-in connector to be kept low, as a result of which the direct plug-in connector is inexpensive to produce. Moreover, if undesired forces act on a direct plug-in connector, no lever torques or merely minimum lever torques occur as a consequence of the arrangement of the contact and the fastening element, as a result of which a higher stability of an electric connection of the direct plug-in connector is achieved.

The conductor can be a cable strand of a cable or a wire.

The contact can have a connector section. The connector section can be configured to establish a releasable electric connection or a non-releasable electric connection to the conductor; in particular, the electric connection between the connector section and the conductor can be a soldered connection, a press joint, a pressure-type connection, an IDC connection, a clamped connection, a plug-in tongue connection, a connection by way of crimping or a welded connection.

The first contact arm can be configured to establish a releasable electric connection to the metallized through opening. In particular, the releasable electric connection can be a plug-in connection. The first contact arm can be configured to be pushed or plugged, in particular multiple times, into the metallized through opening, and to be pulled, in particular multiple times, out of the metallized through opening. In particular, the first contact arm can be of resilient configuration, with the result that a reliable electric connection is established after plugging into the metallized through opening. In other words, the first contact arm can be deformed elastically during plugging into the metallized through opening, as a result of which the first contact arm is prestressed. The prestress can press the first contact arm against the metallized through opening. The first contact arm and/or the contact can have a bevel or a rounded portion on its edges, in particular on its outer edges. The contact is produced from electrically conductive material or is at least coated in an electrically conductive manner.

The fastening element can be configured to act on the metallized through opening or to engage into the metallized through opening in the fastening position, and is configured, for example, in the release position, to be pushed or inserted into the metallized through opening or to be pulled or removed from the metallized through opening. The fastening element can be a flexible element; in particular, the fastening element can be transferred from the fastening position into the release position by way of exertion of force on the fastening element, for example by way of bending or deforming of the fastening element. The fastening element can be prestressed in the release position, the prestress bringing about an automatic transfer of the fastening element from the release position into the fastening position, for example by way of the fastening element springing back into the fastening position. The fastening element is an element which is separate from the contact. The fastening element can be, for example, part of the housing. The fastening element is produced from electrically insulating material or is at least coated with an electrically insulating material.

When the fastening element has been inserted into the metallized through opening, the fastening element can bring about a positively locking connection and/or a non-positive connection to the metallized through opening in the fastening position.

In one development of the invention, the direct plug-in connector has a locking pin which, in a locked state, prevents a transfer of the fastening element from the fastening position into the release position by way of a positively locking connection to the fastening element and, in an unlocked position, makes a transfer of the fastening element from the fastening position into the release position possible. A more stable mechanical fastening of the direct plug-in connector to the metallized through opening is advantageously achieved by way of the locking pin; in particular, an undesired release of the fastening of the direct plug-in connector to the metallized through opening is prevented by way of the locking pin. For example, the locking pin can be transferred multiple times between the unlocked state and the locked state. In the locked state, it is possible that the locking pin is inserted into the fastening element or is received by the fastening element. The locking pin can also be configured to block the fastening element not only in the fastening position, but rather also to press it against the metallized through opening.

In one development of the invention, the contact defines an intermediate space for receiving the locking pin at least in sections, the first contact arm delimiting the intermediate space at least partially, and the locking pin being arranged within the intermediate space at least in the fastening position. A compact overall design is advantageously achieved by way of the said arrangement of the locking pin and the contact.

In one development of the invention, the contact has a second contact arm which is arranged so as to lie opposite the first contact arm, the first contact arm and the second contact arm delimiting the intermediate space at least partially. The stability of an electric connection of a direct plug-in connector is increased by way of the use of a second contact arm. The second contact arm can have the same properties or the same configuration as the first contact arm.

In one development of the invention, the locking pin has at least one first groove, within which the first contact arm is arranged at least in sections in the locked state of the locking pin. For example, the first contact arm is arranged partially within the first groove. In the release position, the first contact arm can likewise be arranged in sections within the first groove.

In one development of the invention, the locking pin has a second groove, within which the second contact arm is arranged at least in sections in the locked state of the locking pin, the second groove being arranged so as to lie opposite the first groove. For example, the second contact arm is arranged partially within the second groove. In the release position, the second contact arm can likewise be arranged in sections within the second groove.

In one development of the invention, the locking pin and/or the first contact arm have/has at least one run-up slope which is configured in each case such that, in the locked state, the locking pin presses or prestresses the first contact arm against the metallized through opening. For example, the run-up slope can be configured such that the locking pin loads the first contact arm with a force in the direction of the metallized through opening. The locking pin and/or the second contact arm can have a further run-up slope which is configured in each case such that, in the locked state, the locking pin prestresses the second contact arm against the metallized through opening.

In one development of the invention, the fastening element has at least one first latching arm with a first latching lug. In order to fasten the direct plug-in connector to the metallized through opening, the first latching lug preferably latches on the metallized through opening or at one end of the through opening, at which end the through opening merges into a lower side of the printed circuit board. The first latching arm can be configured to be pushed or plugged, in particular multiple times, into the metallized through opening, and to be pulled, in particular multiple times, out of the metallized through opening. For example, the first latching arm can be deformed elastically, the first latching arm not being deformed in the fastening position and being deformed in the release position. For example, the first latching lug has a first slope and/or a second slope. The first slope can be configured such that the fastening element is transferred from the fastening position into the release position, in particular to deform and deflect the first latching arm when the fastening element is pushed into the metallized through opening, and/or the second slope can be configured such that the fastening element is transferred from the fastening position into the release position, in particular to deform and deflect the first latching arm when the fastening element is pulled out of the metallized through opening. The second slope can have a greater gradient than the first slope, with the result that a greater force is required for pulling the fastening element out of the metallized through opening than for pushing the fastening element into the metallized through opening.

In one development of the invention, the locking pin bears against a rear side of the first latching arm in the locked state, which rear side faces away from the first latching lug. For example, in the locked state, there is a positively locking connection between the locking pin and the first latching arm, which positively locking connection prevents a transfer, in particular a deformation, of the first latching arm from the fastening position into the release position. The rear side of the first latching arm and/or the locking pin can be provided with a run-up slope. In the locked state, the locking pin can prestress or press the first latching arm against the metallized through opening.

In one development of the invention, the fastening element has a second latching arm with a second latching lug, the second latching arm being arranged so as to lie opposite the first latching arm. The stability of a fastening of the direct plug-in connector to the metallized through opening is increased by way of the use of a second latching arm. The second latching arm can have the same properties or configurations of the first latching arm. The rear side of the second latching arm and/or the locking pin can be provided with a run-up slope. The locking pin can prestress or press the second latching arm against the metallized through opening in the locked state.

In one development of the invention, the locking pin is configured to be pushed between the first latching arm and the second latching arm.

In one development of the invention, the first latching arm and the second latching arm lie in a latching arm plane, the first contact arm and the second contact arm lie in a contact arm plane, and the latching arm plane and the contact arm plane lie perpendicularly on one another.

In one development of the invention, the direct plug-in connector has a housing, the housing having the fastening element. For example, the fastening element can be arranged on a lower side of the housing. The fastening element and the housing are preferably configured in one piece. For example, the fastening element and/or the housing can be made from plastic. Within the housing, the contact can be arranged in a contact-proof and electrically insulated manner with respect to the surroundings.

In one development of the invention, the housing has a first housing part and a second housing part, the first housing part having the fastening element, and the second housing part having the locking pin, it being possible for the first housing part and the second housing part to be displaced relative to one another, the locking pin assuming the unlocked state in a first relative position of the first housing part and the second housing part, and the locking pin assuming the locked state in a second relative position of the first housing part and the second housing part. The locking pin is preferably configured in one piece with the second housing part. A displacement direction of the first housing part relative to the second housing part can be parallel to a longitudinal axis of the metallized through opening and/or parallel to a plug-in direction of the direct plug-in connector into the metallized through opening.

In one development of the invention, the contact has a securing section which is arranged within the housing and secures the contact against falling out of the housing. When the direct plug-in connector has established an electric connection between the conductor and the metallized through opening, the fastening element is situated in the fastening position and tensile forces act on the conductor, the securing section can prevent the contact falling out, in particular being pulled out, of the housing as a consequence of the tensile forces on the conductor, as a result of which a disconnection of the electric connection is prevented.

In one development of the invention, the direct plug-in connector has a centring element which can interact with a corresponding centring element of the printed circuit board and secures the direct plug-in connector against rotation. The centring element can be a centring opening or a centring pin. The corresponding centring element of the printed circuit board can be a centring pin or centring opening. As a rule, a centring opening will be provided on the printed circuit board. For example, the centring element can be arranged on a lower side of the housing, in particular on a lower side of the first housing part. For example, the centring element and the housing can be configured in one piece. For example, the centring element and the corresponding centring element of the printed circuit board can act as a positioning aid when the direct plug-in connector is fastened to the printed circuit board and specifically to the metallized through opening.

Further features and advantages of the invention result from the claims and the following description of preferred embodiments of the invention in conjunction with the drawings. Individual features of the different embodiments which are shown can be combined with one another here in any desired way, without departing from the scope of the invention.

DETAILED DESCRIPTION

Figure 1:
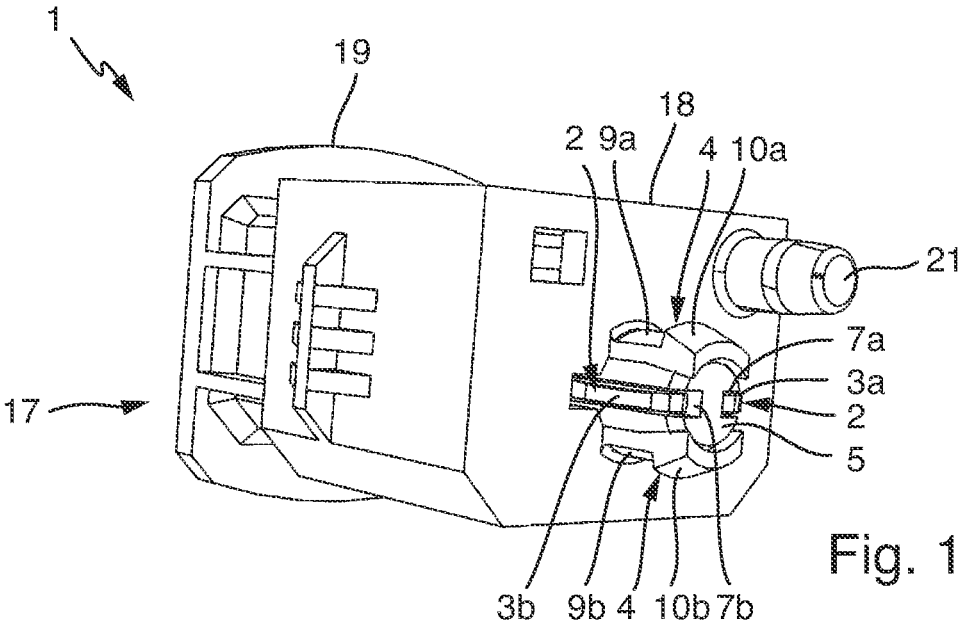
FIG. 1 shows a view of a direct plug-in connector according to the invention obliquely from below.

FIG. 1 shows a view obliquely from below of a direct plug-in connector 1 with a housing 17 which has a first housing part 18 and a second housing part 19. A contact 2 protrudes in sections out of the first housing part 18 on a lower side of the direct plug-in connector 1. A first contact arm 3*a* and a second contact arm 3*b* of the contact 2 protrude in sections out of the first housing part 18. The first contact arm 3*a* is arranged so as to lie opposite the second contact arm 3*b*. The first contact arm 3*a* and the second contact arm 3*b* are provided to connect the contact 2 electrically to a metallized through opening of a printed circuit board. The two contact arms 3*a*, 3*b* lie in a common contact arm plane.

The housing 17 has a fastening element 4 on its lower side, on which the first contact arm 3*a* and the second contact arm 3*b* protrude and which faces the observer in FIG. 1. The fastening element 4 is provided to fasten the direct plug-in connector 1 to the metallized through opening. To this end, the fastening element 4 can assume a fastening position or a release position. When it is situated in the fastening position and is pushed in the metallized through opening, the fastening element 4 holds the direct plug-in connector 1 on the metallized through opening or on the printed circuit board. In the release position, it is possible to push the fastening element 4 into the metallized through opening or to pull it out of the metallized through opening. FIG. 1 shows the fastening position.

The fastening element 4 which is shown in FIG. 1 has a first latching arm 9*a* and a second latching arm 9*b*. The first latching arm 9*a* has a first latching lug 10*a*, and the second latching arm 9*b* has a second latching lug 10*b*. The first latching arm 9*a* is arranged so as to lie opposite the second latching arm 9*b*. The two latching arms 9*a*, 9*b* with their latching lugs 10*a*, 10*b* are configured to latch into the metallized through opening. The two latching arms 9*a*, 9*b* are arranged in a latching arm plane.

FIG. 1 shows that the two contact arms 3*a*, 3*b* and the two latching arms 9*a*, 9*b* are provided to utilize the same metallized through opening firstly for establishing an electric connection and secondly for fastening the direct plug-in connector 1.

Furthermore, FIG. 1 shows that the locking pin 5 is arranged between the two contact arms 3*a*, 3*b* and the two latching arms 9*a*, 9*b*. The locking pin 5 is provided to block the fastening element 4, with the result that the fastening element 4 and specifically the latching arms 9*a*, 9*b* are not transferred unintentionally from the fastening position into the release position.

Figure 2:
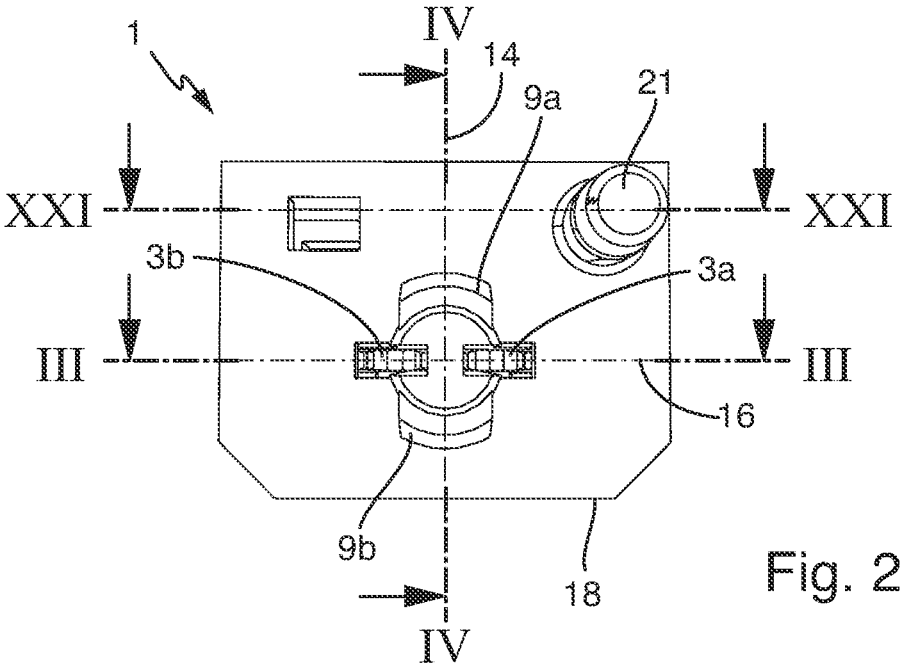
FIG. 2 shows a view of the direct plug-in connector of FIG. 1 from below.

FIG. 2 shows the direct plug-in connector 1 from below. The two latching arms 9*a*, 9*b* lie in a latching arm plane 14, and the contact arms 3*a*, 3*b* lie in a contact arm plane 16, the latching arms 9*a*, 9*b* and the contact arms 3*a*, 3*b* being arranged in such a way that the latching arm plane 14 and the contact arm plane 16 lie perpendicularly on one another.

Figure 3:
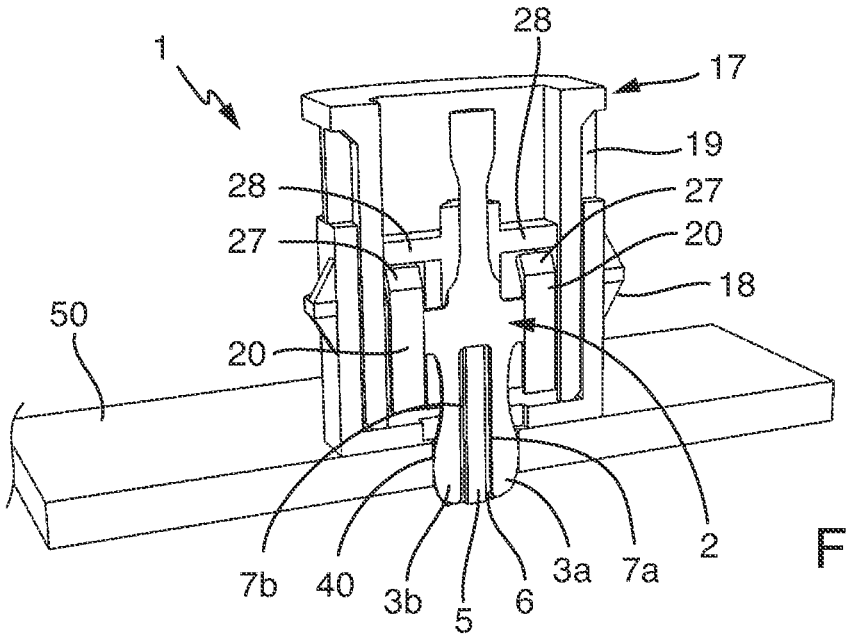
FIG. 3 shows a sectional view of the direct plug-in connector of FIG. 1 on a sectional plane III-III, the direct plug-in connector being fastened to a metallized through opening of a printed circuit board.

FIG. 3 shows a sectional view of the direct plug-in connector 1, the sectional plane III-III being the contact arm plane 16 from FIG. 2. The direct plug-in connector 1 is plugged into a metallized through opening 40 of a printed circuit board 50. The two contact arms 3*a*, 3*b* bear against a wall of the metallized through opening 40, and establish the electric connection to the latter as a result.

Figure 4:
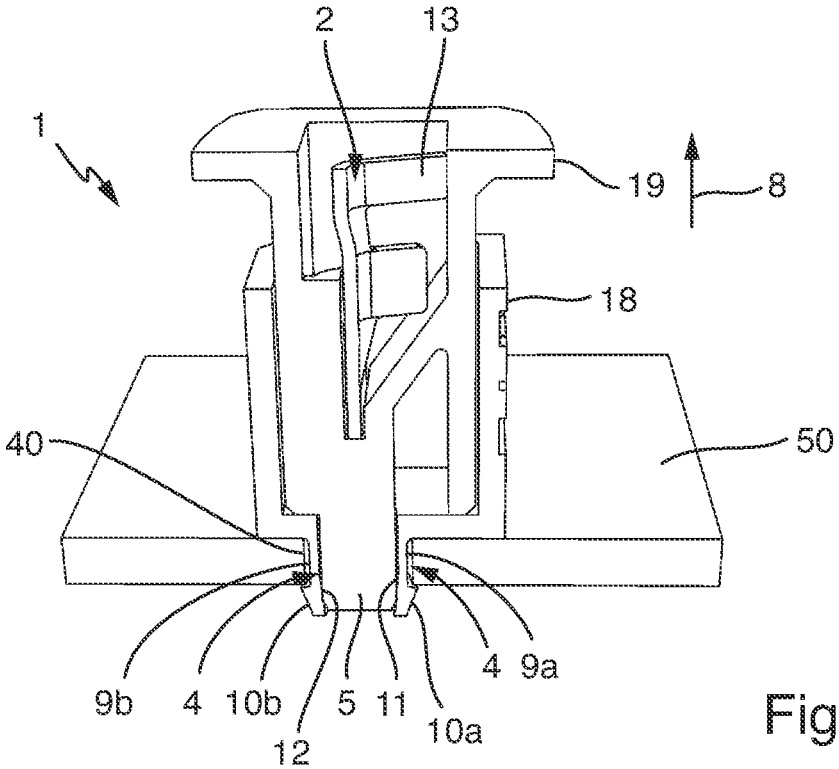
FIG. 4 shows a sectional view of the direct plug-in connector of FIG. 1 on a sectional plane IV-IV, the direct plug-in connector being fastened to the metallized through opening.

FIG. 4 shows a sectional view of the direct plug-in connector 1, the sectional plane IV-IV being the latching arm plane 14 from FIG. 2. The two latching lugs 10*a*, 10*b* are arranged outside the metallized through opening 40, and lie on a lower side of the printed circuit board 50. The two latching lugs 10*a*, 10*b* therefore engage behind the metallized through opening 40 and thus prevent the direct plug-in connector 1 from being pulled off from the printed circuit board 50 unintentionally.

Furthermore, FIG. 4 shows that the locking pin 5 is configured in one piece with the second housing part 19, and that the fastening element 4 is configured in one piece with the first housing part 18.

FIG. 4 shows a locked state of the locking pin 5. The locking pin 5 is pushed between the first latching arm 9*a* and the second latching arm 9*b*, and bears both against a rear side 11 of the first latching arm 9*a* and against a rear side 12 of the second latching arm 9*b*. As a result, a positively locking connection is achieved between the locking pin 5 and the two latching arms 9*a*, 9*b* in a direction parallel to the printed circuit board 50. The said positively locking connection brings it about that the fastening element 4 and the latching arms 9*a*, 9*b* are blocked in the fastening position, and prevents the latching arms 9*a*, 9*b* from being transferred into the release position unintentionally and, as a consequence of this, the direct plug-in connector 1 being detached unintentionally from the printed circuit board 50 and out of the metallized through opening 40.

In order to release the direct plug-in connector 1 from the metallized through opening 40 and therefore from the printed circuit board 50, the locking pin 5 has to be transferred into a non-locked state (not shown). In the illustration of FIG. 4, the locking pin 5 has to be moved together with the second housing part 19 to this end upwards relative to the latching arms 9*a*, 9*b* and the second housing part 18, away from the printed circuit board 50. In the unlocked state, the locking pin 5 is then at least no longer arranged between the two latching lugs 10*a*, 10*b*, and a transfer of the latching arms 9*a*, 9*b* from the fastening position into the release position is possible. If the latching arms 9*a*, 9*b* are transferred into the release position, that is to say are deflected inwards in FIG. 4, the latching lugs 10*a*, 10*b* can move into the through opening 40, and the direct plug-in connector 1 can be pulled out of the metallized through opening 40. In order to transfer the locking pin 5 into the unlocked state, a user pulls on the second housing part 19 in a direction 8 which points away from the printed circuit board. As a result, the second housing part 19 is displaced relative to the first housing part 18 until the two housing parts 18, 19 assume a first relative position. In the first relative position, the locking pin 5 has the unlocked state, and the direct plug-in connector 1 can be pulled out of the metallized through opening 40. In order to fasten the direct plug-in connector 1 to the metallized through opening 40 again, the two latching arms 9*a*, 9*b* together with the two contact arms 3*a*, 3*b* are pushed into the metallized through opening 40 until the two latching lugs 10*a*, 10*b* latch behind the metallized through opening 40, as shown in FIG. 4. Subsequently, a user presses the second housing part 19 counter to the direction 8, as a result of which the second housing part 19 is displaced relative to the first housing part 18 and assumes a second relative position which is shown in FIG. 4. In the second relative position, the locking pin 5 is situated in the locked state, see FIG. 4.

Figure 5:
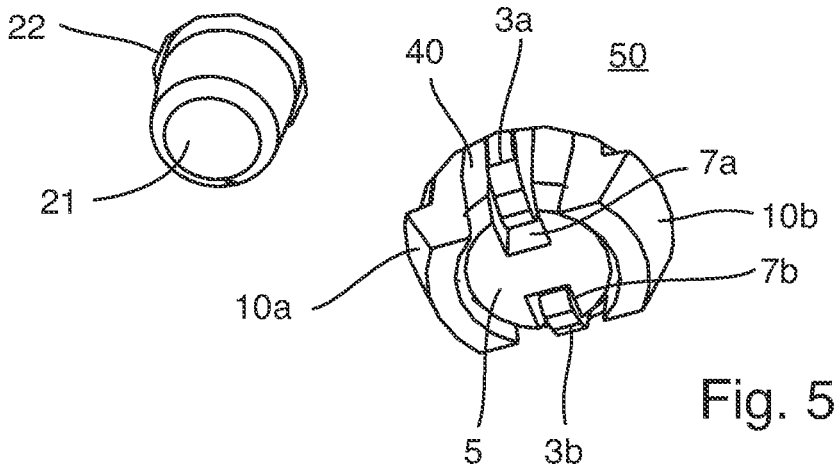
FIG. 5 shows a view of the direct plug-in connector of FIG. 1 obliquely from below, the direct plug-in connector being fastened to the metallized through opening of the printed circuit board.

FIG. 5 shows the direct plug-in connector 1 from below, the direct plug-in connector 1 being connected to the printed circuit board 50. The two contact arms 3*a*, 3*b* bear against the wall of the metallized through opening 40 and establish an electric connection as a result. The two latching lugs 10*a*, 10*b* hold the direct plug-in connector 1 on the printed circuit board 50 via the same metallized through opening 40. The locking pin 5 is situated in the locked state and blocks the latching lugs 10*a*, 10*b*.

Figure 6:
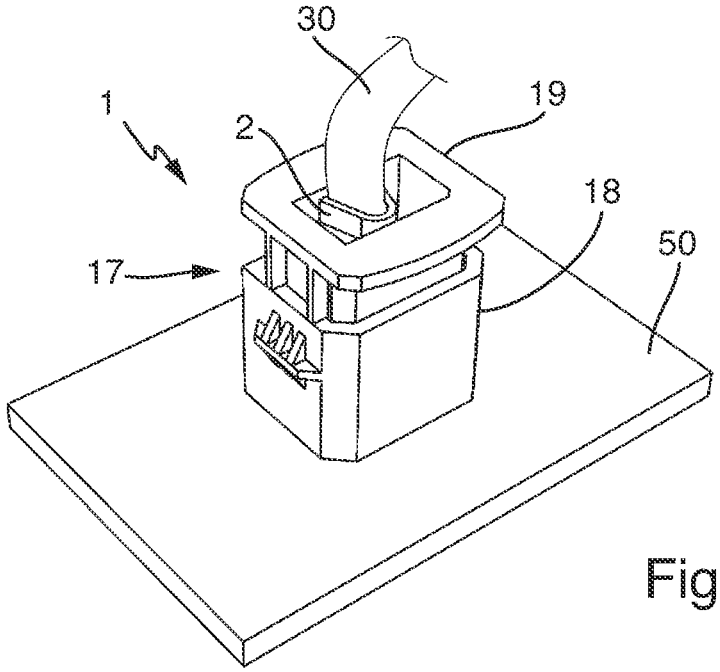
FIG. 6 shows a view of the direct plug-in connector of FIG. 1 obliquely from above, the direct plug-connector being fastened to the metallized through opening of the printed circuit board.

FIG. 6 shows the direct plug-in connector 1 in a view obliquely from above. The direct plug-in connector 1 is fastened to the printed circuit board 50 and establishes an electric connection between a conductor 30 which is connected to the contact 2 and the metallized through opening 40 of the printed circuit board 50.

Figure 7:
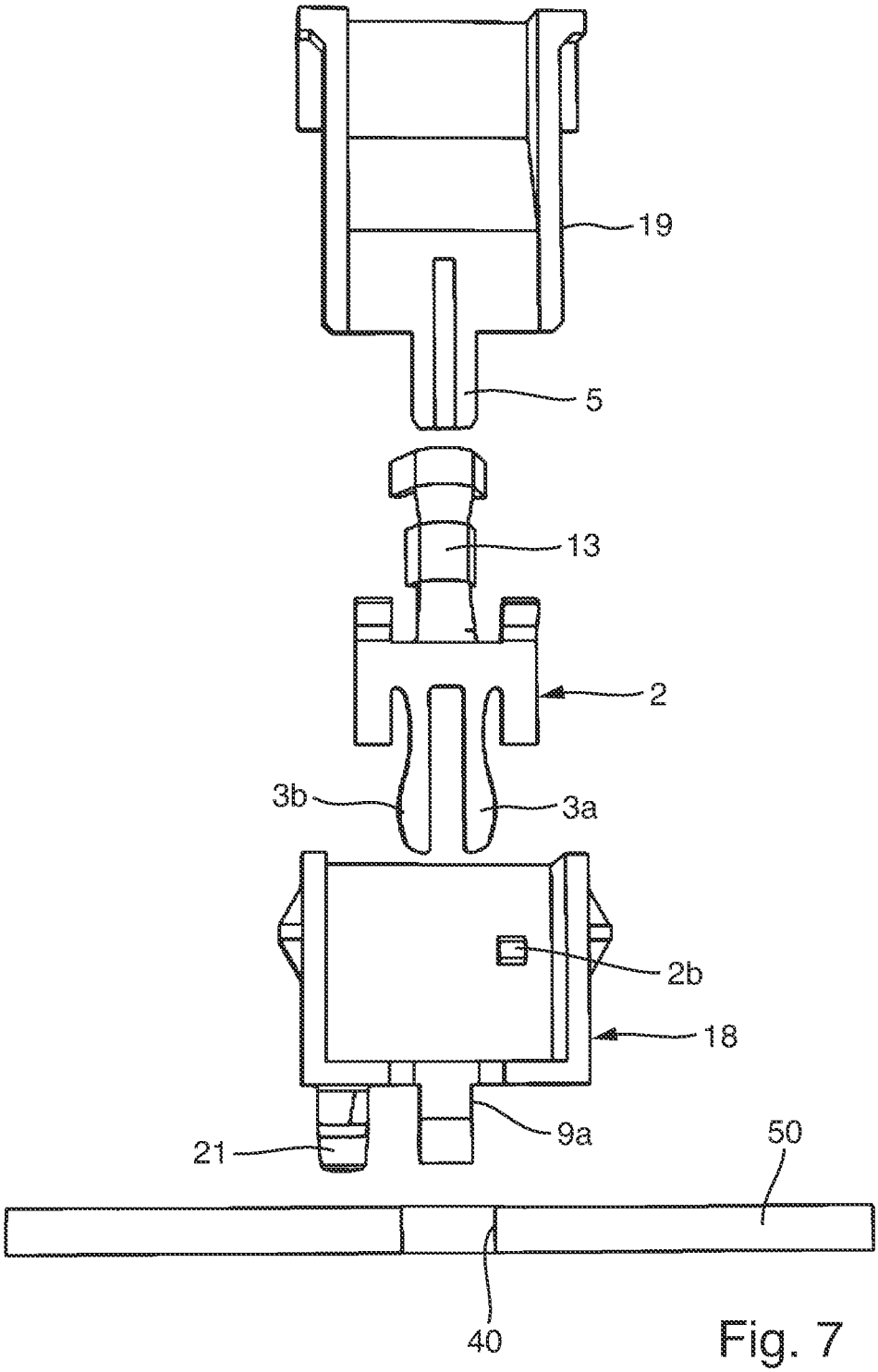
FIG. 7 shows an exploded or pulled-apart illustration of the direct plug-in connector of FIG. 1 with a printed circuit board.

FIG. 7 shows the direct plug-in connector 1 in an exploded illustration or pulled-apart illustration.

Figure 8:
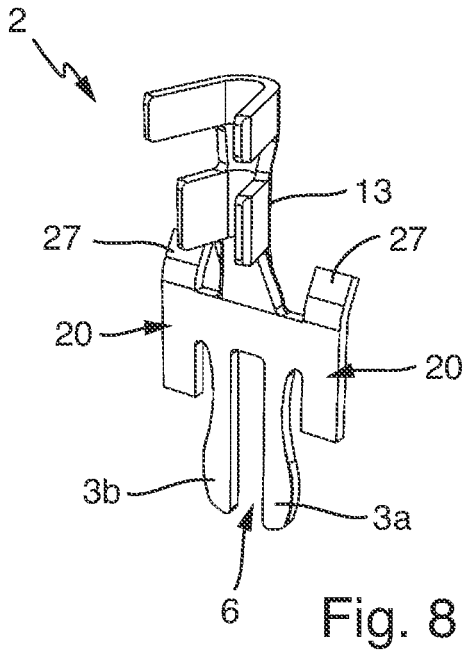
FIG. 8 shows a view of a contact of the direct plug-in connector of FIG. 1 obliquely from the front.
Figure 9:
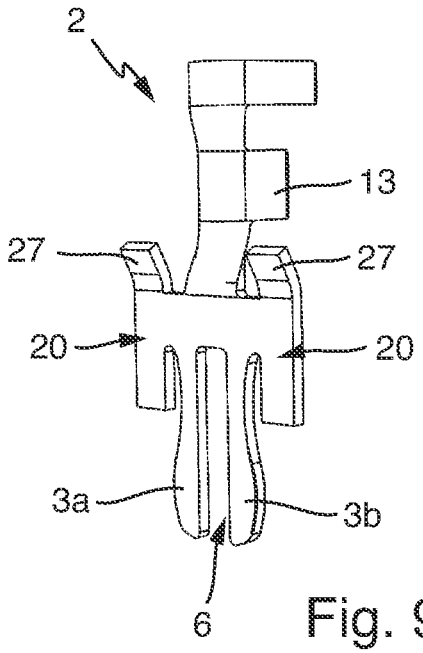
FIG. 9 shows a view of the contact of FIG. 8 obliquely from the rear.

FIGS. 8 and 9 in each case show a view of the contact 2 obliquely from the front and obliquely from the rear, respectively. The contact 2 has a connector section 13. The connector section 13 is configured to establish an electric connection to the conductor 30 and to fasten the conductor 30 to the contact 2. To this end, the conductor 30 is placed into the connector section 13 of the contact 2, and a pressure-type connection or press-in connection is established between the contact 2 and the conductor 30 by way of crimping of the connector section 13. The connector section can be of any desired configuration within the context of the invention, for example also as an insulation displacement contact or as a solder tail.

Furthermore, the contact 2 has a securing section 20, an end 27 of the securing section 20, which end 27 faces the connector section 13, being bent away with respect to the contact arm plane 16, in which the contact arms 3*a*, 3*b* and the remaining securing section 20 lie. In the assembled state of the direct plug-in connector 1, the securing section 20 is arranged within the housing 17 (see also FIG. 3) and secures the contact 2 against falling out of the housing 17. When a conductor 30 is connected by way of the contact 2 to the connector section 13 and the conductor 30 is pulled, the bent-away ends 27 of the securing section 20 butt against a bead 28 of the second housing part 19, which prevents the contact 2 from being pulled out of the housing 17. In other words, a positively locking connection between the bead 28 and the end 27 prevents the contact 2 from falling out of the housing 17.

The contact 2 is configured integrally from one piece of flat sheet metal material. The sheet metal material is first of all punched or lasered, in order subsequently to configure the connector section 13 and the end 27 of the securing section 20 by way of bending.

Furthermore, FIGS. 8 and 9 show that the contact 2 defines an intermediate space 6, the first contact arm 3*a* and the second contact arm 3*b* delimiting the intermediate space 6 at least partially. In the fastening position of the locking pin 5, the locking pin 5 is arranged within the intermediate space 6 (see also FIG. 3). To this end, the locking pin 5 has a first groove 7*a*, within which the first contact arm 3*a* is arranged partially, and a second groove 7*b*, within which the second contact arm 3*b* is arranged partially (see also FIG. 1). Because the two contact arms 3*a*, 3*b* are arranged so as to lie opposite one another, the grooves 7*a*, 7*b* are likewise arranged so as to lie opposite one another.

Figure 10:
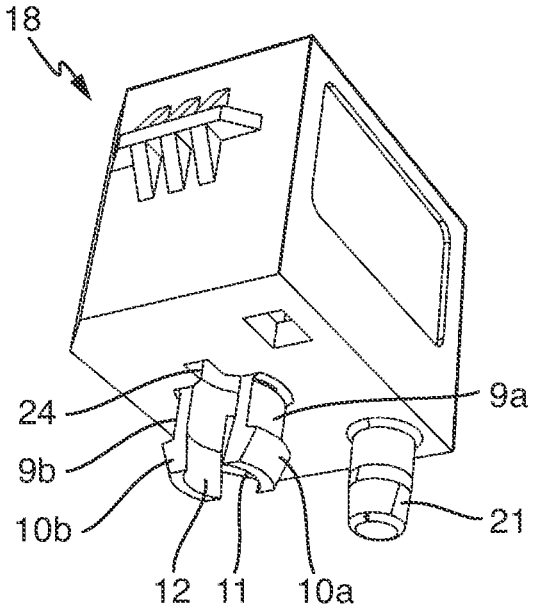
FIG. 10 shows a view of a first housing part of the direct plug-in connector of FIG. 1 obliquely from below.
Figure 11:
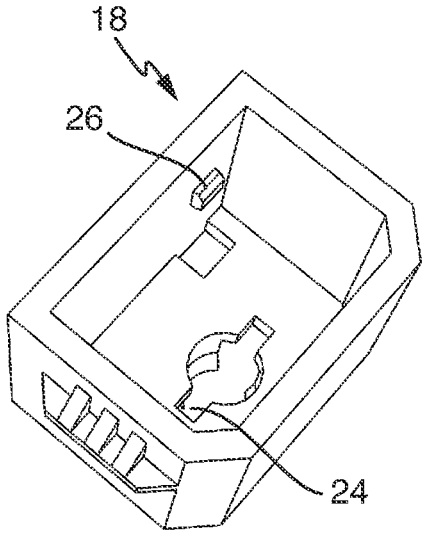
FIG. 11 shows a view of the first housing part of FIG. 10 obliquely from above.

FIGS. 10 and 11 in each case show an oblique view of the first housing part 18. The first housing part 18 has a contact recess 24. The contact recess 24 is provided such that, in the case of the assembly of the direct plug-in connector 1, the contact 2 can be inserted into the first housing part 18 in such a way that the two contact arms 3*a*, 3*b* protrude partially out of the first housing part 18 and are arranged between the two latching arms 9*a*, 9*b*.

Figure 12:
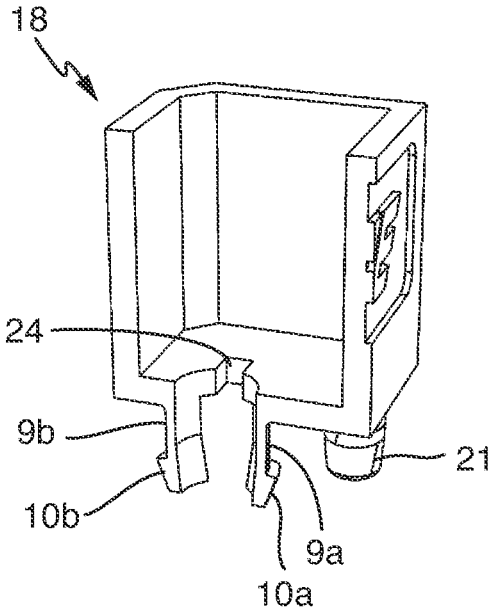
FIG. 12 shows a first sectional view of the first housing part of FIG. 10.
Figure 13:
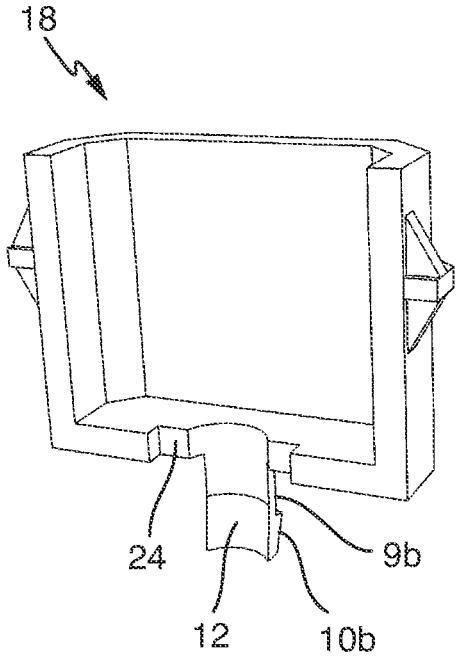
FIG. 13 shows a second sectional view of the first housing part of FIG. 10.

FIGS. 12 and 13 in each case show a sectional view of the first housing part 18, the sectional plane IV-IV in FIG. 12 being the latching arm plane 14 from FIG. 2, and the sectional plane III-III in FIG. 13 being the contact arm plane 16 from FIG. 2.

Figure 14:
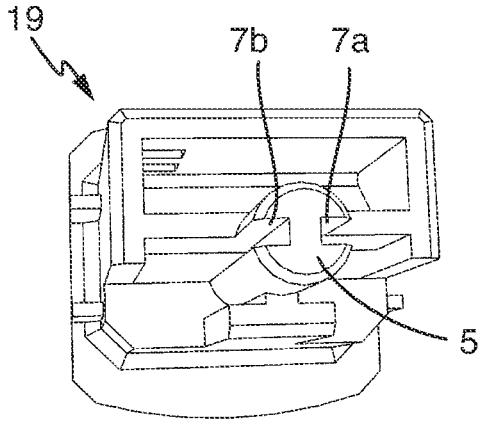
FIG. 14 shows a view of a second housing part of the direct plug-in connector of FIG. 1 obliquely from below.
Figure 15:
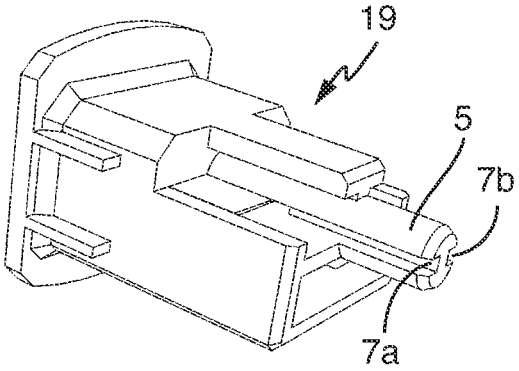
FIG. 15 shows a view of the second housing part of FIG. 14 obliquely from the side.

FIGS. 14 and 15 in each case show an oblique view of the second housing part 19 with the locking pin 5 which is configured in one piece and the two grooves 7*a*, 7*b*.

Figure 16:
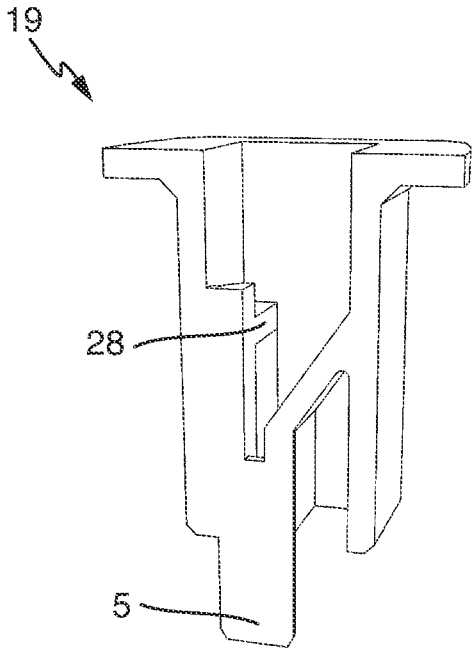
FIG. 16 shows a first sectional view of the second housing part of FIG. 14.
Figure 17:
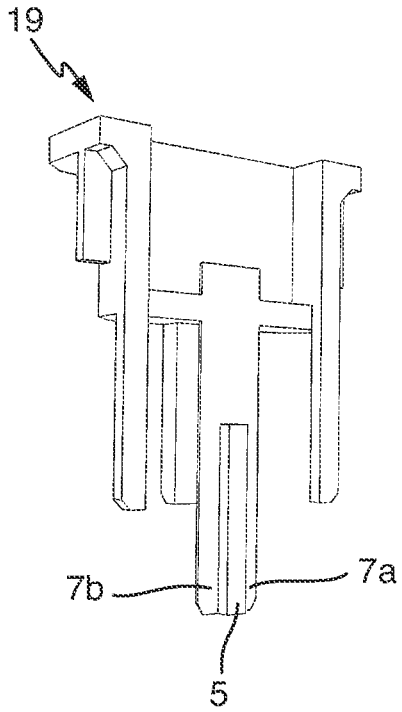
FIG. 17 shows a second sectional view of the second housing part of FIG. 14.

FIGS. 16 and 17 in each case show a sectional view of the second housing part 19, the sectional plane IV-IV in FIG. 16 being the latching arm plane 14 from FIG. 2, and the sectional plane III-III in FIG. 17 being the contact arm plane 16 from FIG. 2.

Figure 18:
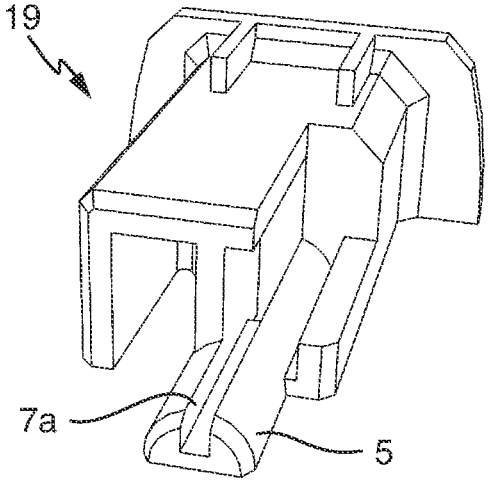
FIG. 18 shows the second housing part, which is sectioned according to FIG. 16, obliquely from above.
Figure 19:
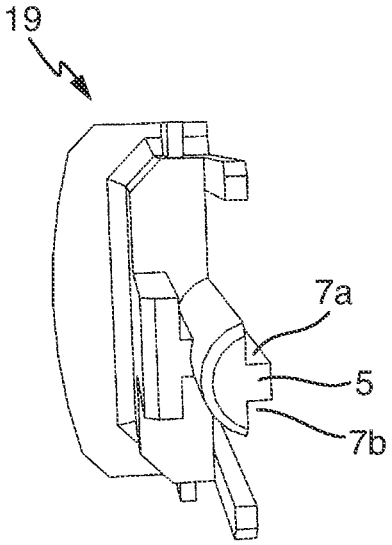
FIG. 19 shows the second housing part, which is sectioned according to FIG. 17, obliquely from the side.

FIGS. 18 and 19 in each case show a different perspective of the sectional views of the second housing part 19 from FIGS. 16 and 17.

Figure 20:
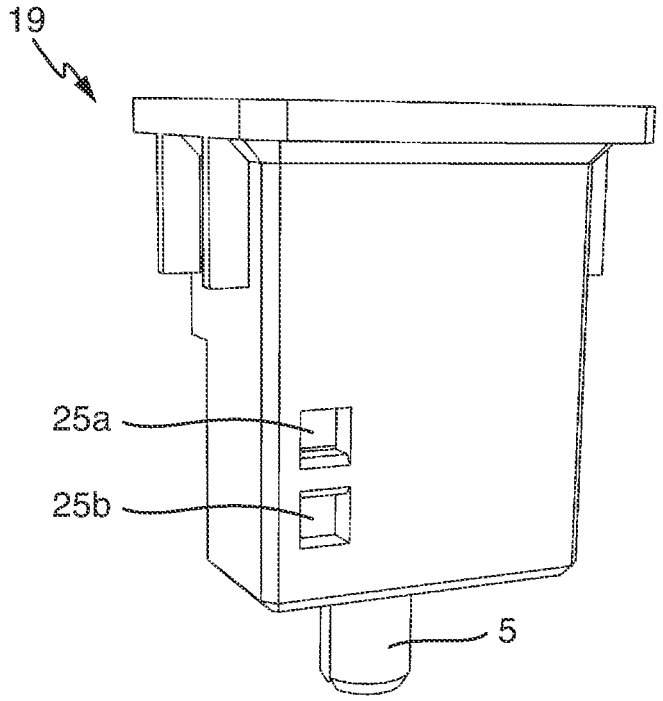
FIG. 20 shows a view of the second housing part of FIG. 14 obliquely from the side.

FIG. 20 shows an oblique view of the second housing part 19 from FIG. 14 from a different perspective. The second housing part 19 has an upper latching opening 25*a* and a lower latching opening 25*b*. Latching lugs 26 of the first housing part 18 can engage into the said latching openings 25*a*, 25*b* (see also FIG. 11). When the first housing part 18 and the second housing part 19 are in the first relative position, the latching lug 26 is arranged within the lower latching opening 25*b*. When the first housing part 18 and the second housing part 19 are in the second relative position, the latching lug 26 is arranged within the upper latching opening 25*a*. Therefore, the first relative position and the second relative position of the two housing parts 18, 19 and therefore also the unlocked state and the locked state of the locking pin 5 are fixed by way of the latching lug 26 and the latching openings 25*a*, 25*b*. If a user transfers the two housing parts 18, 19 between the two relative positions by way of pressing or pulling on the second housing part 19, the user perceives as a result of the latching of the latching lug 26 into one of the two latching openings 25*a*, 25*b* that the first relative position or the second relative position is now reached.

Figure 21:
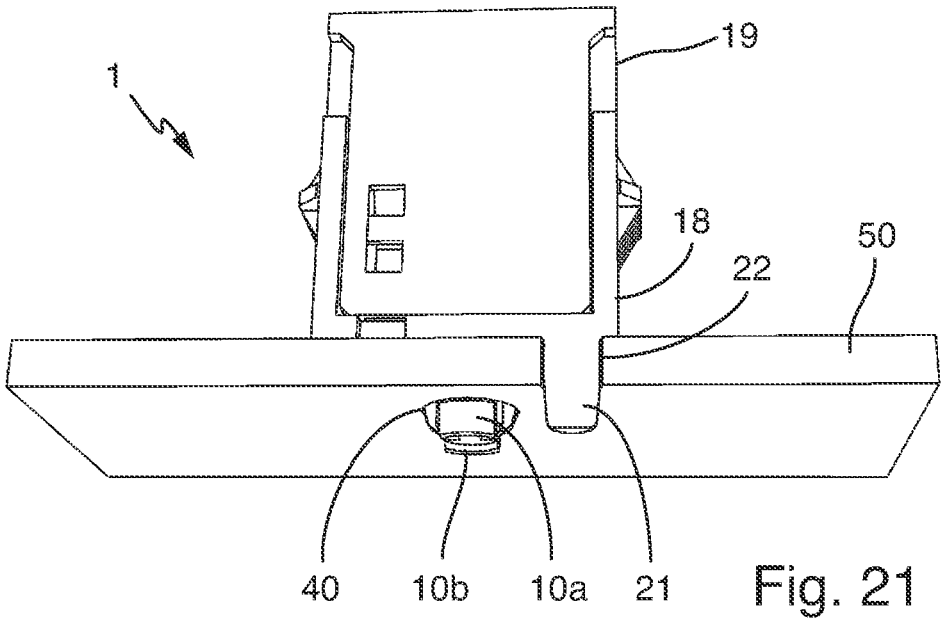
FIG. 21 shows a view of the direct plug-in connector of FIG. 1 on a sectional plane XXI-XXI.

FIG. 21 shows a sectional view of the direct plug-in connector 1, the associated sectional plane being shown in FIG. 2 by way of the reference sign XXI-XXI. The first housing part 18 has a centring element 21 in the form of a centring pin which is received in a corresponding centring element 22 in the form of a centring opening of the printed circuit board. The centring element 21 is provided to position the direct plug-in connector 1 correctly in the case of fastening to the printed circuit board 50 and, in the fastened state on the printed circuit board 50, to prevent a rotation of the direct plug-in connector 1.

Figure 22:
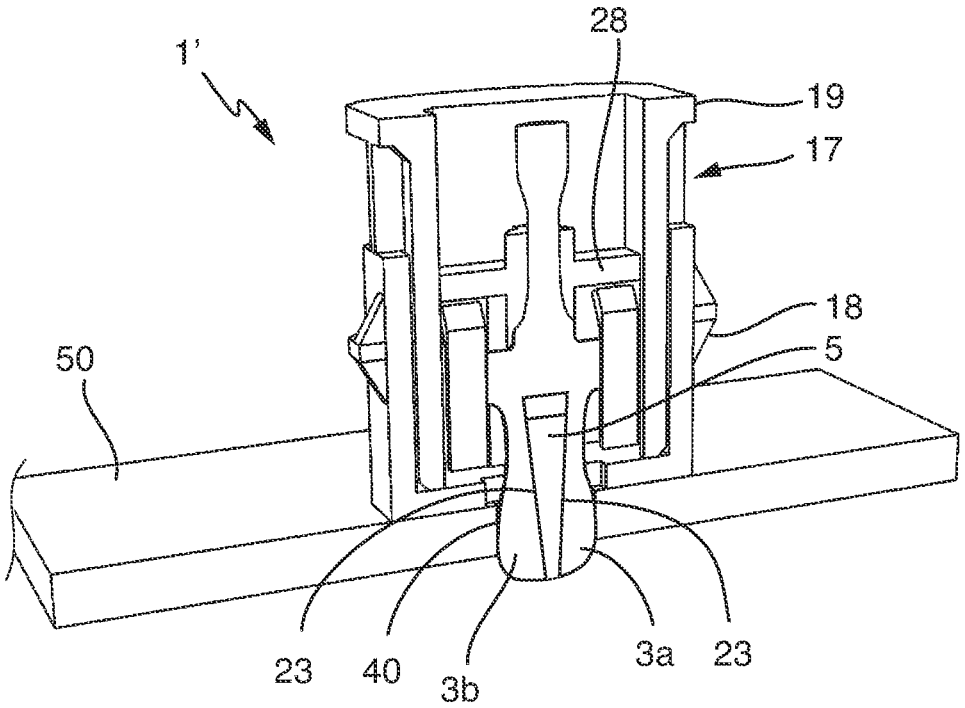
FIG. 22 shows a sectional view of a further embodiment of a direct plug-in connector according to the invention obliquely from above, which direct plug-in connector is fastened to a metallized through opening of a printed circuit board.

FIG. 22 shows a sectional view of a direct plug-in connector 1'. The direct plug-in connector 1' is an alternative exemplary embodiment of the direct plug-in connector 1 from FIGS. 1-21, identical reference signs being used for identical and functionally equivalent elements for improved comprehension, and it being possible to this extent for reference to be made to the above comments with respect to the exemplary embodiments of FIG. 1 to FIG. 21, with the result that essentially merely the existing differences will be described in the following text. The locking pin 5 and the two contact arms 3*a*, 3*b* in each case have a run-up slope 23. When the two housing parts 18, 19 are transferred from the first relative position into the second relative position, the run-up slopes 23 come into contact and interact in such a way that the contact arms 3*a*, 3*b* are pressed to the outside. When the contact arms 3*a*, 3*b* are inserted into the metallized through opening 40 and the two housing parts 18, 19 assume the second relative position, as shown in FIG. 22, the contact arms 3*a*, 3*b* are prestressed or pressed against a wall of the metallized through opening 40. As a result, a greater stability of the electric connection between the contact arms 3*a*, 3*b* and the metallized through opening 40 is achieved. This can be of great advantage, for example, in the case of mobile applications, in the case of which the direct plug-in connector 1' and the printed circuit board 50 are subjected to vibrations.

As the exemplary embodiments which are shown and described above make clear, the invention provides a direct plug-in connector which has a compact overall design, is inexpensive to produce, and increases the stability and reliability of an electric connection.

The invention claimed is:

1. Direct plug-in connector for establishing an electric connection between a conductor and a metallized through opening of a printed circuit board, having:

a contact with at least one first contact arm, the first contact arm being configured for the electric connection of the conductor to the metallized through opening, a fastening element which can assume a fastening position and a release position, characterized in that the fastening element is configured for fastening the direct plug-in connector to the metallized through opening in the fastening position, the fastening element having at least one first latching arm with a first latching lug;

a locking pin which, in a locked state, prevents a transfer of the fastening element from the fastening position into the release position by way of a positively locking connection to the fastening element and, in an unlocked state, makes a transfer of the fastening element from the fastening position into the release position possible, the contact defining an intermediate space for receiving the locking pin at least in sections, the first contact arm delimiting the intermediate space at least partially, and the locking pin being arranged within the intermediate space at least in the fastening position.

2. Direct plug-in connector according to claim 1, the contact having a second contact arm which is arranged so as to lie opposite the first contact arm, the first contact arm and the second contact arm delimiting the intermediate space at least partially.

3. Direct plug-in connector according to claim 1, the locking pin having at least one first groove, within which the first contact arm is arranged in the locked state.

4. Direct plug-in connector according to claim 3, the locking pin having a second groove, within which the second contact arm is arranged in the locked state, the second groove being arranged so as to lie opposite the first groove.

5. Direct plug-in connector according to claim 1, the locking pin and/or the first contact arm having a run-up slope which is configured in each case such that, in the locked state, the locking pin prestresses the first contact arm against the metallized through opening.

6. Direct plug-in connector according to claim 1, the locking pin bearing against a rear side of the first latching arm in the locked state, which rear side faces away from the first latching lug.

7. Direct plug-in connector according to claim 6, the fastening element having a second latching arm with a second latching lug, the second latching arm being arranged so as to lie opposite the first latching arm.

8. Direct plug-in connector according to claim 7, the locking pin being configured to be pushed between the first latching arm and the second latching arm.

9. Direct plug-in connector according to claim 2, the first latching arm and the second latching arm lying in a latching arm plane, the first contact arm and the second contact arm lying in a contact arm plane, and the latching arm plane and the contact arm plane lying perpendicularly with respect to one another.

10. Direct plug-in connector according to claim 1, having a housing, the housing having the fastening element.

11. Direct plug-in connector according to claim 10, the housing having a first housing part and a second housing part, the first housing part having the fastening element, and the second housing part having the locking pin, it being possible for the first housing part and the second housing part to be displaced relative to one another, the locking pin assuming the unlocked state in a first relative position of the first housing part and the second housing part, and the locking pin assuming the locked state in a second relative position of the first housing part and the second housing part.

12. Direct plug-in connector according to claim 10, the contact having a securing section which is arranged within the housing and secures the contact against falling out of the housing.

13. Direct plug-in connector according to claim 1, having a centering element which can interact with a corresponding centering element of the printed circuit board, in order to secure the direct plug-in connector against rotation.

14. Direct plug-in connector according to claim 2, the locking pin bearing against a rear side of the first latching arm in the locked state, which rear side faces away from the first latching lug.

* * * * *